US005887374A

United States Patent [19]

Brass

[11] Patent Number: 5,887,374

[45] Date of Patent: Mar. 30, 1999

[54] FIREARM SIGHTING DEVICE

[76] Inventor: William D. Brass, 18890 SW. Wedgfield Ln., Aloha, Oreg. 97707

[21] Appl. No.: 968,665

[22] Filed: Nov. 12, 1997

[51] Int. Cl.[6] ..... E41A 27/02

[52] U.S. Cl. ..... 42/94; 89/37.01; 33/335

[58] Field of Search ..... 42/94; 891/37.04, 891/37.08, 37.09, 37.12, 37.13, 37.14; 33/235

[56] References Cited

U.S. PATENT DOCUMENTS

| | | | |
|---|---|---|---|
| 2,774,563 | 12/1956 | Pribis | 89/37.04 |
| 3,703,046 | 11/1972 | Barone et al. | 42/94 |
| 4,007,554 | 2/1977 | Helmstadter | 42/94 |
| 4,012,860 | 3/1977 | Auger | 42/94 |
| 4,055,017 | 10/1977 | Thompson | 42/94 |
| 4,776,124 | 10/1988 | Clifton | 42/94 |
| 4,858,359 | 8/1989 | Danz | 42/94 |
| 4,924,616 | 5/1990 | Bell | 42/94 |
| 5,375,337 | 12/1994 | Butler | 42/94 |
| 5,491,919 | 2/1996 | Rather et al. | 42/94 |
| 5,596,830 | 1/1997 | Morgan | 42/94 |

*Primary Examiner*—Charles T. Jordan
*Assistant Examiner*—Denise J. Buckley
*Attorney, Agent, or Firm*—Patent & Trademark Services; Joseph H. McGlynn

[57] ABSTRACT

An eccentric firearm sighter which has a stand that supports a cylinder with a V-shaped groove in its outer surface to support a firearm. The cylinder has a plurality of eccentric apertures at different distances from the center of the cylinder. The sights on the firearm can be adjusted by clamping the cylinder and rotating it in the stand on a bolt that is inserted in one of the eccentric apertures.

4 Claims, 1 Drawing Sheet

FIREARM SIGHTING DEVICE

BACKGROUND OF THE INVENTION

This invention relates, in general, to sights for firearms, and, in particular, to a device for aiding in the adjustment of sights for a firearm.

DESCRIPTION OF THE PRIOR ART

In the prior art various types of sighting devices for firearms have been proposed. For example, U.S. Pat. No. 4,012,860 discloses a sighting device which has a support member which is oscillatably supported from a base for angular adjustment about a horizontal axis.

U.S. Pat. No. 4,055,017 discloses a bench rest for firearms which permits articulation for both pitch and yaw.

U.S. Pat. No. 5,596,830 discloses a firearm rest which has a base and a seat which is adjustably attached to the base by means of a plurality of apertures on one member and a plurality of pins on the other member.

U.S. Pat. No. 5,375,337 discloses a device for adjusting the sights on a hand gun which has a pair of laterally spaced legs on the front and a vertically adjusting leg on the rear.

SUMMARY OF THE INVENTION

The present invention is an eccentric firearm sighter which has a stand that supports a cylinder with a V-shaped groove in its outer surface to support a firearm. The cylinder has a plurality of eccentric apertures at different distances from the center of the cylinder. The sights on the firearm can be adjusted by clamping the cylinder in the stand, and rotating it on a bolt that is inserted in one of the eccentric apertures.

It is an object of the present invention to provide a tool for adjusting the sights on a firearm.

It is an object of the present invention to provide a tool for adjusting the sights on a firearm which is inexpensive to manufacture and simple to operate.

These and other objects and advantages of the present invention will be fully apparent from the following description, when taken in connection with the annexed drawings.

DESCRIPTION OF THE PREFERRED EMBODIMENT

Figure 1:
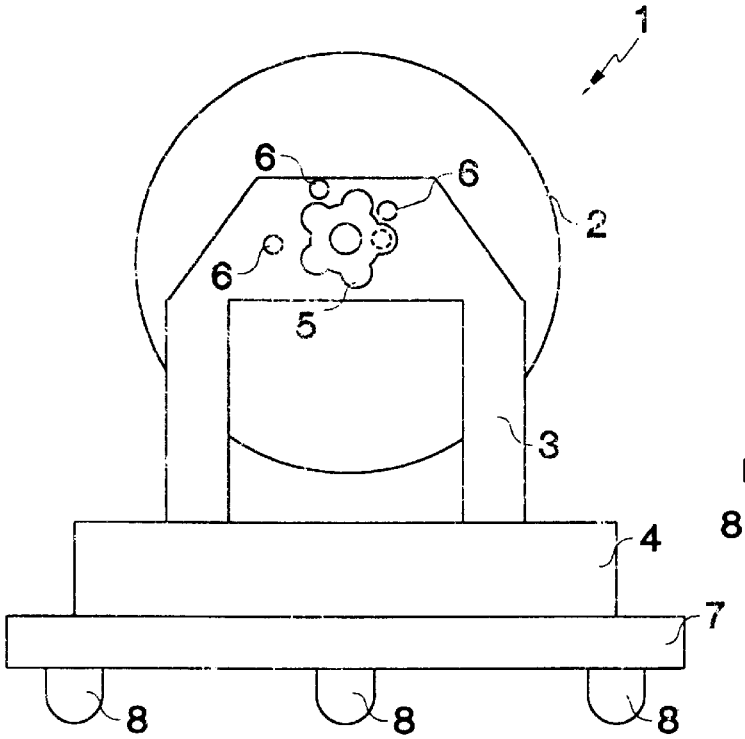
FIG. 1 is side view of the present invention.
Figure 3:
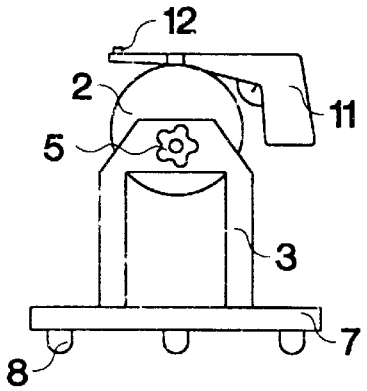
FIG. 3 is a view of the present invention showing a firearm at the highest point of adjustment.
Figure 4:
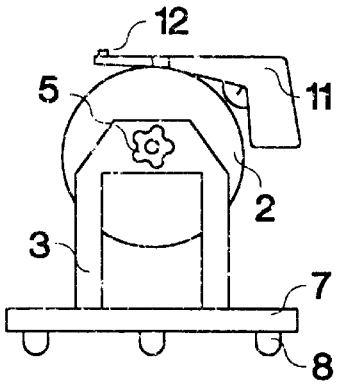
FIG. 4 is a view of the present invention showing a firearm at the lowest point of adjustment.

Referring now to the drawings in greater detail, FIG. 1 shows the sight adjustment tool 1 of the present invention. The tool has a stand 3, composed of a pair of space support elements which will hold a cylinder 2 in a selected position therebetween, so that a firearm 11, as seen in FIGS. 3 and 4 can be mounted and the sights 12 can be properly adjusted. The stand 3 is attached to a base 7 by any conventional means such as, but not limited to, screws. In addition, as shown in FIGS. 1 and 2, an adjustment block 4 can be inserted between the stand 3 and the base 7 to increase the height of the tool so that a user over 6'-2" in height can use the tool more comfortably.

A cylinder 2 is secured to the stand 3 by means of a bolt 10 with a head 15 and a rubber washer on one end and a threaded end 13 on the other end. The bolt will be inserted through a central aperture in the cylinder 2 and secured with a handle 5 with internal threads to receive the threaded end 13 of the bolt 10. Spaced at different distances from the central aperture in the cylinder 2 are a plurality of apertures 6. These apertures will be used to create different height variances for adjusting the sights 12 as shown in FIGS. 3 and 4, in order to "get the sights on the target". The apertures 6 are spaced ¼ inch, ½ inch, ¾ inch and 1 ⅛ inches form the center of the cylinder 2. It should be noted that the number of apertures and the respective distances form the center of the cylinder are merely provided for illustration purposes, and the number of apertures and the respective distances form the center of the cylinder can be varied without departing from the scope of the invention.

Figure 2:
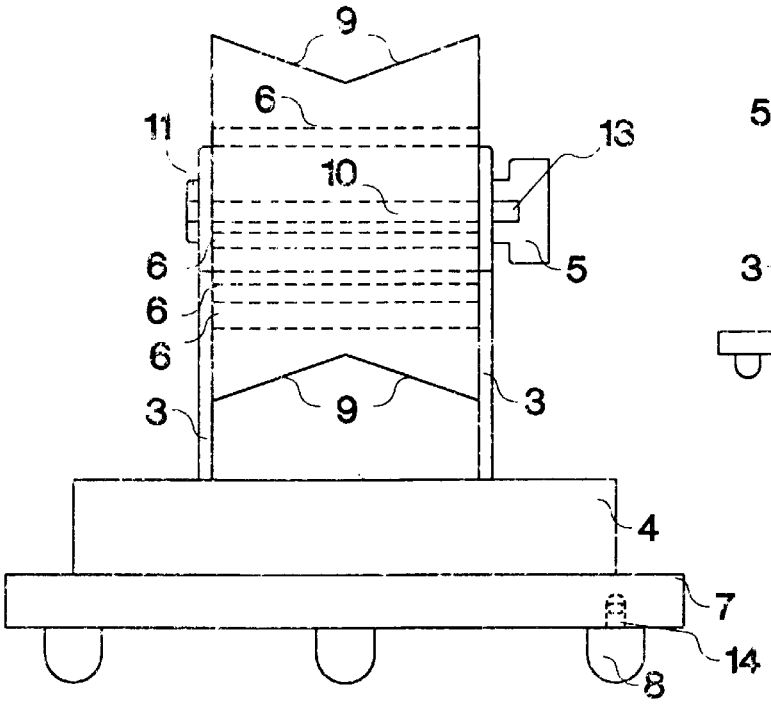
FIG. 2 is a back view of the present invention.

In addition the cylinder 2, as shown in FIG. 2 has a V-shaped groove formed by sloping sides 9 in its circumference. The V-shape will allow the groove to receive different widths of firearms. In addition, it should be noted that a pistol 11 is shown as being used with the present invention in FIGS. 3 and 4, however, this is merely for illustration purposes and the invention is not limited to be used only pistols. Also, the base 7 is provided with large rubber bumpers 8 which are large enough to allow the base to be placed on uneven surfaces. The bumpers can be attached to the base 7 by ¾ X 8 screws 14, integrally secured to the bumpers and threaded into the bottom of the base 7.

In use, a user will place the cylinder 2 in one of the eccentric holes and clamp it in position using the rotatable handle 5. Next a firearm 11 will be placed on a cloth in the V-shaped grove and the firearm will be sighted on a target. A sandbag or other conventional support (not shown) can be used to support the butt of the firearm, and then the user will fire the gun at a target. Next he will inspect the target to determine the distance the sights need to be adjusted. The user will loosen the thumb screw slightly, then rotate the cylinder 2 up or down, and retighten the bolt 10 and again fire at the target. This process will be repeated until the user is satisfied that the gun is hitting the target correctly. Then he will adjust the gun sights to the correct position. The reason for the plurality of holes in the cylinder is that some shooters are more proficient and need less change in height. The novice will probably use the hole that gives him/her the greatest change in height.

Also, it should be noted that even though the present invention has been described as being used to adjust a gun sight, it could also be used to adjust other gun related items such as a telescopic sight.

Although the Eccentric Sighter and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A tool for adjusting the sights on a firearm comprising:

a base having a length, width, a top surface and a bottom surface, a support stand mounted on said top surface, said support stand comprising a pair of spaced support elements, a cylinder mounted between said support elements, said cylinder having a central aperture extending therethrough, said cylinder also having a plurality of off center apertures extending therethrough, each of said off center apertures being positioned away from said center aperture a different distance, and means for securing said cylinder to said support stand.

2. The tool for adjusting the sights on a firearm as claimed in claim 1, wherein said means for securing said cylinder to said support stand is a bolt having a rubber washer and a head on one end and a threaded end on an opposite end, and a handle having internal threads, said bolt extending through one of said central aperture or said off center apertures and said handle being threadably attached to said threaded end of said bolt.

3. The tool for adjusting the sights on a firearm as claimed in claim 1, wherein said base has adjustable means secured to said bottom surface for adjusting said base to uneven surfaces.

4. The tool for adjusting the sights on a firearm as claimed in claim 1, wherein said base has an adjusting means secured to said top surface for adjusting the height of said support stand.

* * * * *